US005462150A

United States Patent [19]

Chang

[11] Patent Number: 5,462,150

[45] Date of Patent: Oct. 31, 1995

[54] COLLECTING DEVICE FOR CURRENCIES

[75] Inventor: Yuan F. Chang, Taipei, Taiwan

[73] Assignee: Gamemax Corporation, Taipei, Taiwan

[21] Appl. No.: 239,528

[22] Filed: May 9, 1994

[51] Int. Cl.[6] ..... G07F 7/04

[52] U.S. Cl. ..... 194/206; 194/350

[58] Field of Search ..... 194/206, 207, 194/344, 347, 350, 349

[56] References Cited

U.S. PATENT DOCUMENTS

| | | | |
|---|---|---|---|
| 4,880,096 | 11/1989 | Kobayashi et al. | 194/206 |
| 5,005,688 | 4/1991 | Yukimoto et al. | 194/206 |
| 5,014,857 | 5/1991 | Kondo | 194/206 X |
| 5,092,445 | 3/1992 | Kozima | 194/206 |
| 5,222,584 | 6/1993 | Zouzoulas | 194/207 |
| 5,325,952 | 7/1994 | McGinley et al. | 194/206 X |
| 5,333,714 | 8/1994 | Watabe et al. | 194/206 |
| 5,368,147 | 11/1994 | Menke et al. | 194/206 |

*Primary Examiner*—Michael S. Huppert
*Assistant Examiner*—Scott L. Lowe

[57] ABSTRACT

A collecting device for currencies comprises a lower housing, a supporting bracket for the housing, an upper housing, a front lid and a rear housing. A plurality of rectangular openings and symmetrically disposed elongate slots are provided at the supporting plate. A conveyor is disposed between the basic slot and the rectangular openings of the supporting plate which extends also to another side wall. A pair of sensors are provided between the basic slot and the rectangular openings of the supporting plate. A pair of projecting pins and a positioning dowel are provided at both sides of the upper housing. Each of the projecting pins has a hook at the lower end thereof. The hook is engaged with the clipping hole of the side wall. The hole of the guiding plate can slide onto the dowel. A sensor is disposed in the upper housing to identify the paper currency. The upper housing is inserted into a locking-plate. The upper housing is moveable with respect to the lower housing by a screw passing through the pulley and positioning slot, then locked to the threaded hole of the upper housing.

6 Claims, 4 Drawing Sheets

COLLECTING DEVICE FOR CURRENCIES

BACKGROUND OF THE INVENTION

This invention relates to a collecting device, and more particularly, to a collecting device for currencies which detects the amount of the currencies and recognizes whether or not the currency received is a forgery.

FIELD OF THE INVENTION

No matter how many precautions are taken, there are still a plurality of forged currencies in circulation. This causes a great deal of loss to both banks and individuals. In order to actually prevent receipt of any forged currency, various kinds of identifiers have been introduced into the market. These currency identifiers can make an identification of whether or not the currency is a forgery on only one kind of currency. If the currencies to be identified exceed three, then at least three identifiers are needed. This will not only cause a great expense, but also will be inconvenient.

In our modern society, there are a plurality of vending machines provided for different sales, such as drinks, cigarettes, etc. When the consumer would like to buy some product from a vending machine, he/she inserts a certain amount of coins into the slot block, then the product he/she intends to buy comes out. But at present, some vending machines can .not receive paper money. The consumer can therefore not use paper money to buy a product from the vending machine. Accordingly, it causes an inconvenience to the consumer who does not have coins in hand.

SUMMARY OF THE INVENTION

It is the object of this invention to provide an identifier which can actually recognize whether the currency or coins received is a forgery. Accordingly, a sensor and a guiding plate are provided.

It is still the object of this invention to provide an identifier which can be readily installed onto any kind of vending machine.

It is still the object of this invention to provide an identifier wherein the forged currency is immediately rejected when the currency is determined to be a forgery.

In order to achieve the object set forth, a pair of symmetrically disposed sensors are provided between the basic slot and the supporting plate of the housing. These sensors can facilitate an identification of whether or not the money is a forgery. The housing is provided with a guiding place at each side and a third sensor is provided for detecting the amount of the currency and whether it is a forgery.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The structural and operational characteristics of the present invention and its advantages as compared to the known state of the prior art will be better understood from the following description, relating to the attached drawings which show illustratively, but not restrictively, an example of a collecting device for currencies. In the drawings.

DETAILED DESCRIPTION OF A PREFERRED EMBODIMENT

Figure 1:
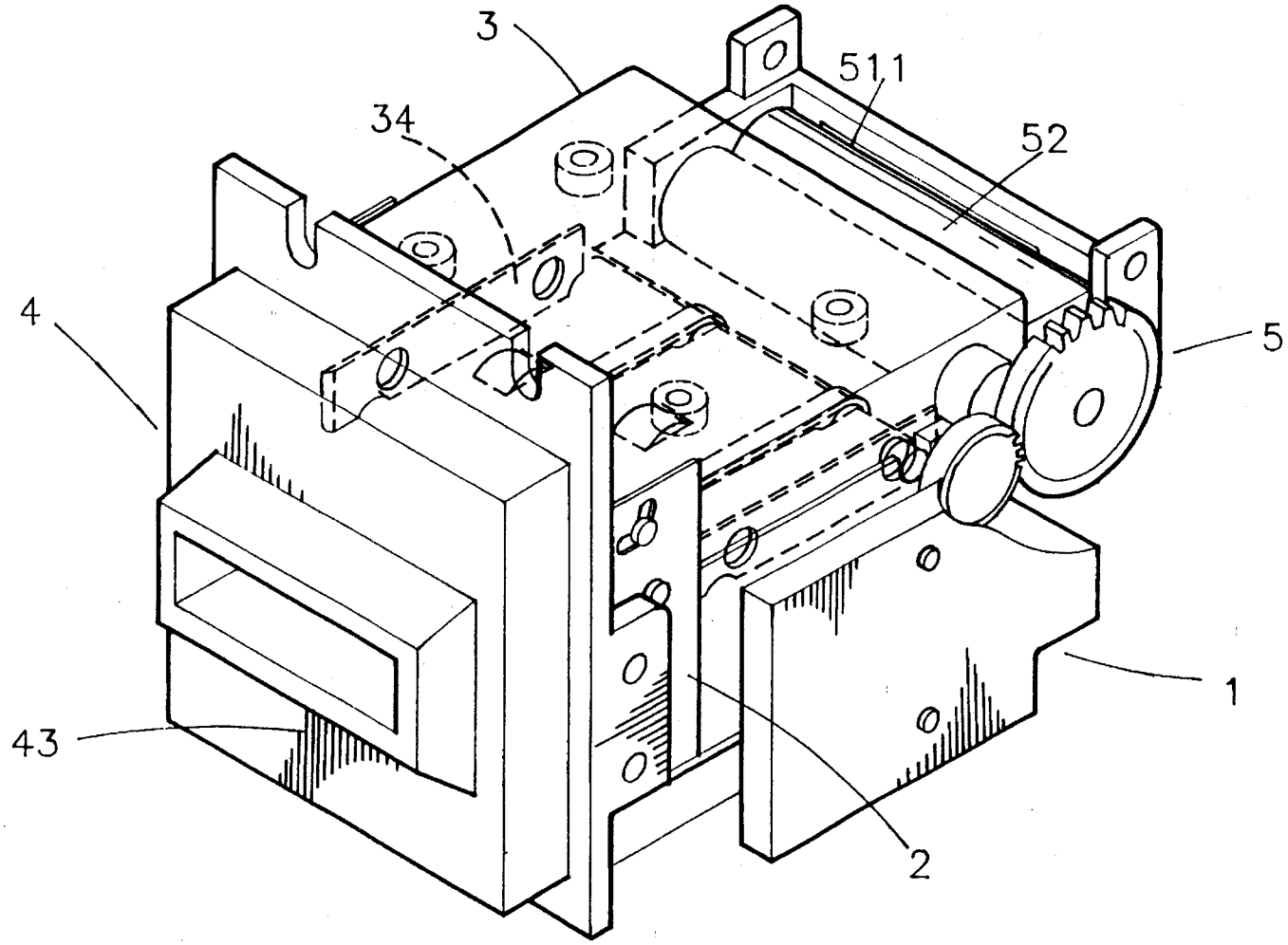
FIG. 1 is a perspective view of the present invention.
Figure 2:
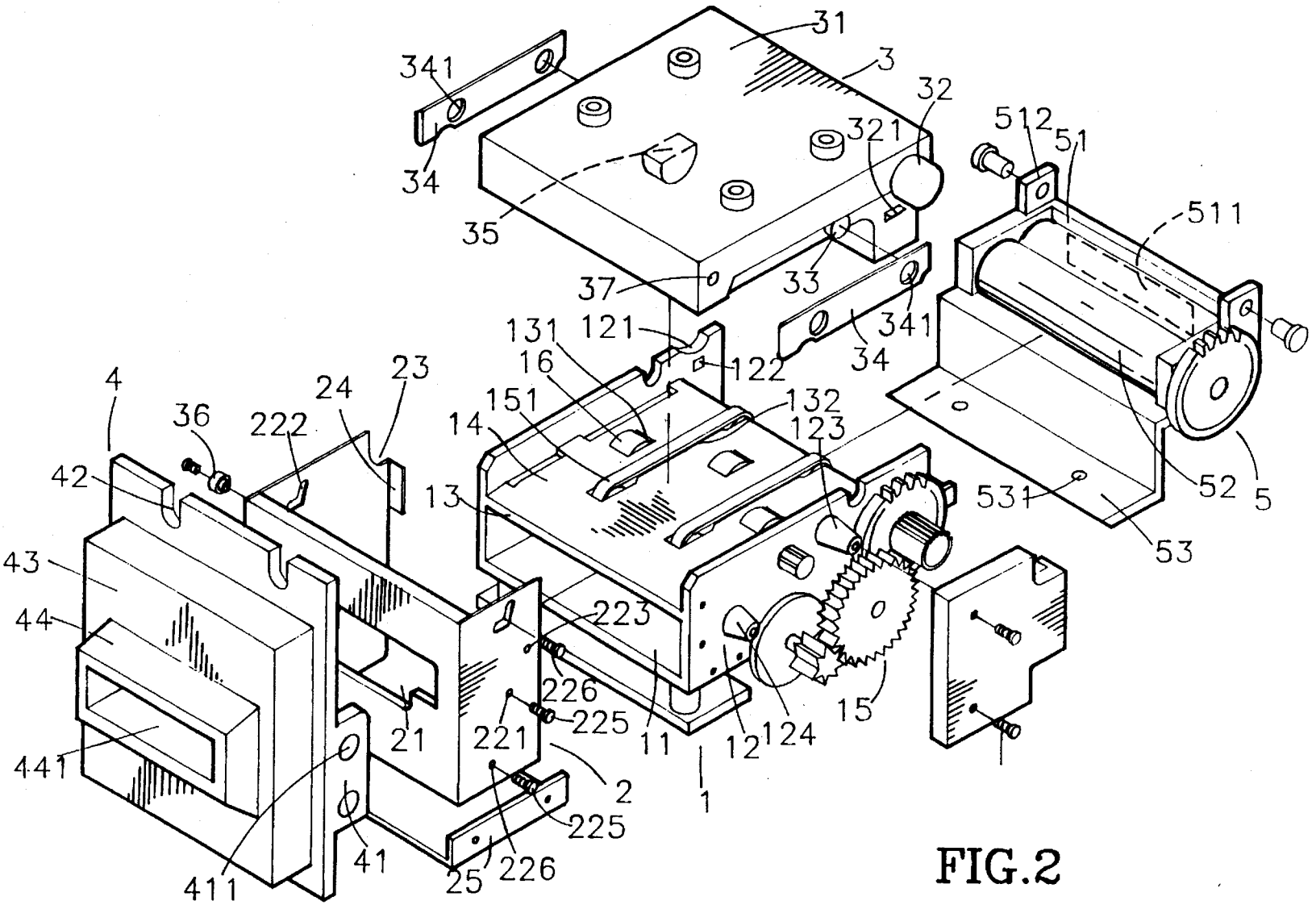
FIG. 2 is an exploded perspective view of the present invention.

Referring to FIGS. 1 and 2, the collecting device for currencies made according to this invention comprises a lower housing 1, a supporting bracket 2 for housing 1, an upper housing 3, a front lid 4 and a rear housing 5.

The lower housing 1 is provided with a basic slot 11. A cutoff 121 is provided at the extension from the side wall 12 of said lower housing 1. A clipping hole 122 and a post 123 and a locking post 124 are provided. A supporting plate 13 is bridged between said side walls 12 thereby defining a delivering space 14. A plurality of rectangular openings 131 and symmetrically disposed elongate slots 132 are provided in said supporting plate 13.

A conveying means 15 is disposed between the basic slot 11 and the rectangular openings 131 of said supporting plate 13 which extends also to another side wall 12. A pair of sensors 16 are provided between the basic slot 11 and the rectangular openings 131 of said supporting plate 13. A pair of symmetrically disposed belts 151 are disposed on said conveying means 15 for transferring the currencies 7. On the other hand, the conveying means 15 is in contact with the lid 17 and is locked to the post 123 by means of screws 171.

The supporting bracket 2 for the housing is provided with an inlet 21 at the front portion. The inlet 21 is attached with a locking plate 22 which has symmetrically disposed holes 221 and a positioning slot 222 and a positioning hole 223. The other side of the locking plate 22 is provided with a cut-out 23 and a bending plate 224 to support the upper housing 3. The supporting bracket 2 is received into the side walls 12 of said basic slot 11. A screw 225 is used to lock on the locking post 123 of the side walls 12. The bottom plate 25 is disposed at the lower housing 1. By means of the screw 225, the supporting bracket 2 is attached to the bottom plate 25.

An upper housing 3 is provided with a lid 31. A pair of projecting pins 32 and a positioning dowel 33 are provided at both sides of the upper housing 3. Each of said projecting pins 32 has a hook 321 at the lower end. The hooks 321 are engaged with the clipping hole 122 of the side wall 12. The hole 341 of the guiding plate 34 can slide onto the dowel 33. A sensor 35 is disposed in said upper housing 3 to identify the paper currency 7. The upper housing 3 is inserted into a locking plate 22. The upper housing 3 is moveable with respect to the lower housing 1 by means of a screw 26 passing through the pulley 36 and positioning slot 222, then locked to the threaded hole 37 of the upper housing 3.

A front lid 4 is provided with a clipping plate 41 and cut-out slot 42 at both sides. A pair of symmetrically disposed threaded holes 411 are provided on said clipping plate 41. A pair of screws 412 are locked onto the threaded holes 226 of the side walls 12. An extended block 43 is provided at the front portion of the front lid 4. A currency receiving socket 44 is attached to the extended block 43. An inlet port 441 is provided on the currency receiving socket 44 which passes through the lid 4. Accordingly, a route for paper money 7 is defined.

A rear housing 5 has a slot 51 therein. Said slot 51 has a roller 52 and an outlet 511 is provided at the side wall of the slot 51. A connecting plate 512 is provided at each side of said slot to facilitate a connection to the money box 6. An L-shape connecting plate 53 is provided at said slot 53. Said L-shape connecting plate is provided with a pair of threaded holes 531. By this arrangement, the rear housing 5 is attached to the bottom of the lower housing 1. Accordingly, the paper money 7 is delivered to the money box 6.

Figure 3:
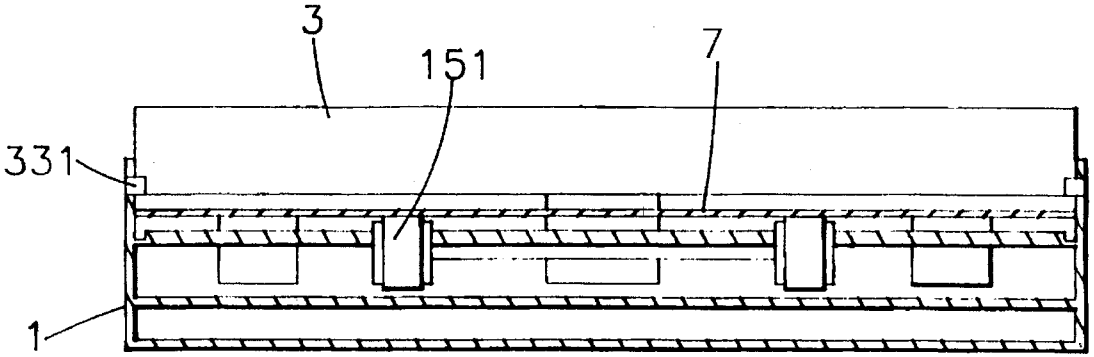
FIG. 3 is a cross sectional view of the present invention.
Figure 5:
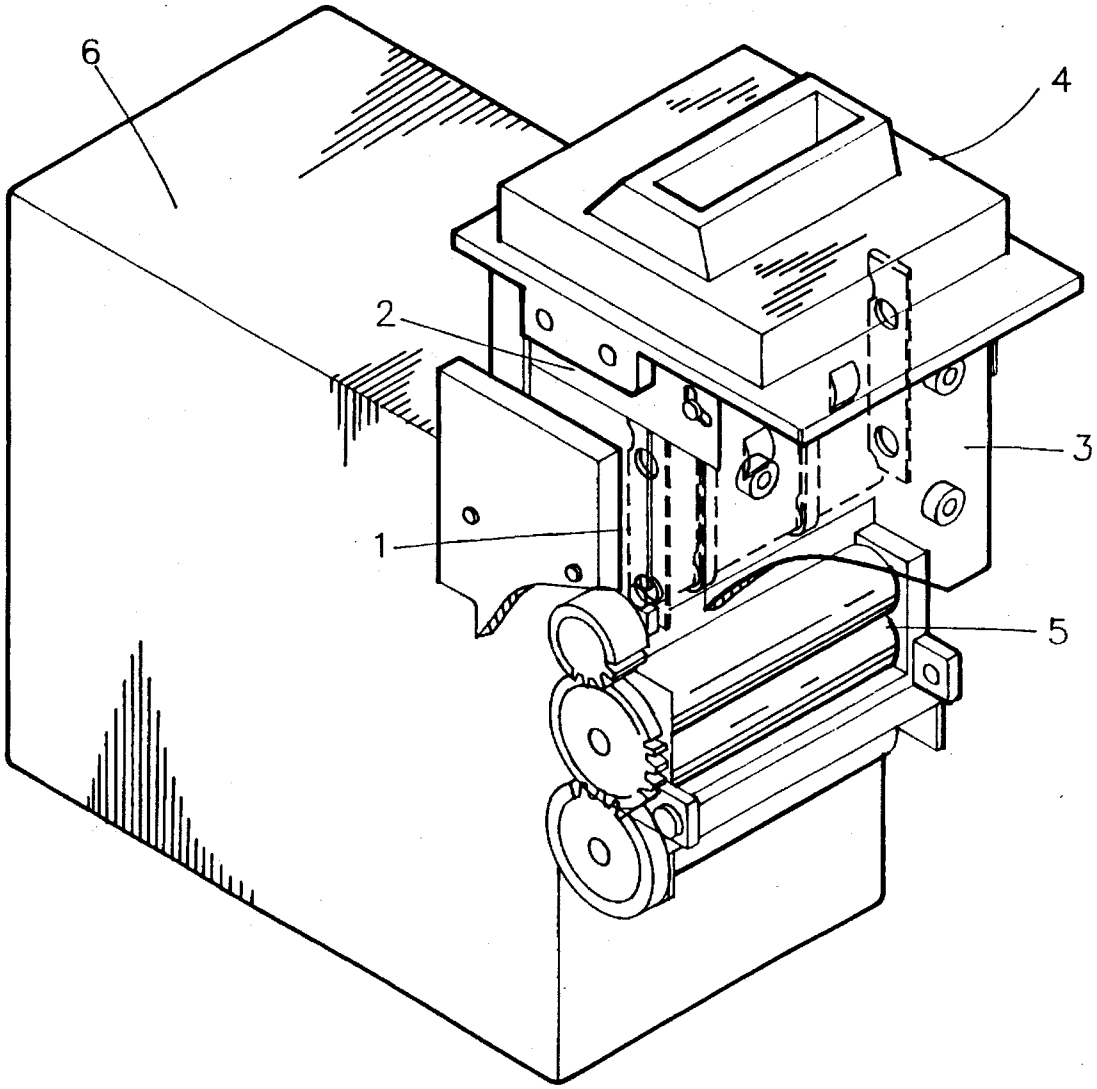
FIG. 5 is an embodiment of the present invention.

Referring to FIGS. 3 and 5, when the guiding plate 34 is not installed, the paper money (New Taiwan dollars, for example) 7 enters the inlet port 441 provided at the currency receiving socket 44. Then the paper money 7 is delivered by the belt 151 of the conveying means 15. In the route of the paper money 7, a sensor 16 is used to identify whether or not it is a forgery. If the paper money 7 is a true one, then the paper money 7 is sent to the money box 6 through the rollers 52 of the slot 51 of the rear housing 5.

Figure 4:
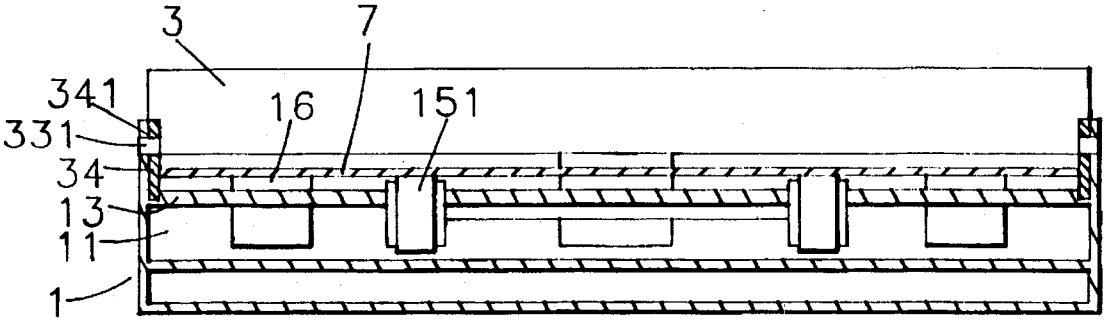
FIG. 4 is another cross sectional view of the present invention.

Referring to FIGS. 4 and 5, when a foreign currency, for example, U.S. or Canadian currency, is to be identified, the upper housing 3 can be opened to install the guiding plate 34. When the money paper 7 enters the inlet port 441 provided at the currency receiving socket 44, the paper money 7 is delivered by the belt 151 of the conveying means 15. Along the route of the paper money 7, a sensor 35 disposed in the upper housing 3 is used to identify whether the bill is a forgery. If the paper money 7 is a true one, then the paper money 7 is sent to the money box 6 through the rollers 52 of the slot 51 of the rear housing 5.

Although the present invention has been described in connection with preferred embodiments thereof, many other variations and modifications will now become apparent to those skilled in the art without departing from the scope of the invention. It is preferred, therefore, that the present invention not be limited by the specific disclosure herein, but only by the appended claims.

I claim:

1. A collecting device for currencies comprising a lower housing, a supporting bracket connected to the lower housing, an upper housing, a front lid positioned adjacent a forward portion of the lower and upper housings, and a rear housing positioned adjacent a rear portion of the lower and upper housings;

the lower housing having two side walls and upper and lower supporting plates extending between the two side walls, the side walls each having a cut-out, a clipping hole, a post and a locking post, the cut-outs receiving the upper housing, the upper and lower supporting plates defining a basic slot therebetween, a delivering space being defined between the two side walls and adjacent to the upper supporting plate, a plurality of rectangular openings and symmetrically disposed elongated slots being provided in the upper supporting plate, the lower housing further comprising, conveyor means for conveying currency, the conveying means being mounted to at least one of the posts on at least one of the side walls, the conveying means including a pair of belts which are located in the elongated slots in the supporting plate, and a pair of sensors located both in the basic slot and in the rectangular openings of the upper supporting plate, the upper housing having two side walls and a lid, a projecting pin and a positioning dowel being provided on each of the side walls of the upper housing, each of the projecting pins being located adjacent to a hook, said hooks being engaged with the clipping holes of the side walls of the lower housing, the upper housing further comprising, a guide plate on each of the side walls of the upper housing, each of the guide plates having a hole defined therein, the holes in the guide plates being received on the dowels of the side walls of the upper housing, and an upper housing sensor for identifying currency, said upper housing sensor being mounted to the lid, and the supporting bracket having a locking plate, the upper housing being inserted into the locking plate, the locking plate having a positioning slot defined therein, a screw passing through the positioning slot and being connected to the upper housing whereby the upper housing is movably mounted with respect to the lower housing.

2. The collecting device as recited in claim 1, wherein the rear housing has a rear wall and side walls defining a slot, a roller being provided in said slot and an outlet being defined in the rear wall of the rear housing, a connecting plate being provided at each side of the slot for mounting a money box thereon, an L-shaped connecting plate being provided in front of the slot, the L-shaped connecting plate being provided with a pair of threaded holes by which the rear housing is mounted to a bottom of the lower housing.

3. The collecting device as recited in claim 1, wherein the front lid comprises two clipping plates on two opposite sides thereof and two cut-out slots on two other opposite sides thereof, a pair of symmetrically disposed threaded holes being provided on each of the clipping plates, four screws each being locked through a respective threaded hole to mount the front lid to the supporting bracket, the front lid further comprising an extended block provided at a front portion of the front lid, a currency receiving socket being defined in the extended block, an inlet port being provided at the currency receiving socket and a route for currency being provided through the front lid via the inlet port.

4. The collecting device as recited in claim 1, wherein the supporting bracket further comprises an inlet at a front portion thereof, the inlet being defined in the locking plate, the locking plate having symmetrically disposed holes and a positioning slot on each side thereof, at least one of the sides of the locking plate having a cutoff and a bent plate for supporting the upper housing, the supporting bracket being mounted on the locking posts of the side walls of the lower housing, the supporting bracket further having a bottom plate, the bottom plate being detachably mounted to the lower housing.

5. The collecting device as recited in claim 4, wherein the front lid comprises two clipping plates on two opposite sides thereof and two cut-out slots on two other opposite sides thereof, a pair of symmetrically disposed threaded holes being provided on each of the clipping plates, four screws each being locked through a respective threaded hole to mount the front lid to the supporting bracket, the front lid further comprising an extended block provided at a front portion of the front lid, a currency receiving socket being defined in the extended block, an inlet port being provided at the currency receiving socket and a route for currency being provided through the front lid via the inlet port.

6. The collecting device as recited in claim 5, wherein the rear housing has a rear wall and side walls defining a slot, a roller being provided in said slot and an outlet being defined in the rear wall of the rear housing, a connecting plate being provided at each side of the slot for mounting a money box thereon, an L-shaped connecting plate being provided in front of the slot, the L-shaped connecting plate being provided with a pair of threaded holes by which the rear housing is mounted to a bottom of the lower housing, currency being conveyed through the inlet port in the front lid, over the upper supporting plate, past the roller in the slot in the rear housing and out of the outlet in the rear wall of the rear housing if the sensors in the rectangular openings in the upper supporting plate of the lower housing and the upper housing sensor on the lid of the upper housing accepts the currency.

* * * * *